United States Patent [19]

Kirsch et al.

[11] 4,142,334

[45] Mar. 6, 1979

[54] SCOURING AND CLEANING CLOTH

[75] Inventors: Wilhelm Kirsch, Birkenau; Bohuslav Tecl; Erich Fahrbach, both of Weinheim, Bergstr., all of Fed. Rep. of Germany

[73] Assignee: Firma Carl Freudenberg, Weinheim, Bergstr., Fed. Rep. of Germany

[21] Appl. No.: 804,835

[22] Filed: Jun. 8, 1977

[30] Foreign Application Priority Data

Jun. 23, 1976 [DE] Fed. Rep. of Germany ..... 7619792 [U]

[51] Int. Cl.[2] ..... B24D 11/00

[52] U.S. Cl. ..... 51/395; 15/104.93; 15/209 C; 51/402; 51/404

[58] Field of Search ..... 51/394–398, 51/400–405, 407; 15/209, 104.93

[56] References Cited

U.S. PATENT DOCUMENTS

| | | | |
|---|---|---|---|
| 1,657,784 | 1/1928 | Bergstrom | 51/397 X |
| 2,288,714 | 7/1942 | Jones | 15/104.93 |
| 2,665,528 | 1/1954 | Sternfield | 51/402 X |
| 2,984,052 | 5/1961 | Mueller | 51/404 |
| 3,293,683 | 12/1966 | Wyant | 15/104.93 |
| 3,491,495 | 1/1970 | Prince | 51/394 |
| 3,641,719 | 2/1972 | Yang | 51/402 |
| 3,664,064 | 5/1972 | Scheuer | 51/402 |

*Primary Examiner*—Nicholas P. Godici

*Attorney, Agent, or Firm*—Sprung, Felfe, Horn, Lynch & Kramer

[57] ABSTRACT

A scouring and cleaning cloth having a coating of a solid binding agent on at least a portion of each surface in an open pattern applied by a printing process, said pattern comprising superelevated bars, the bars in at least one surface having embedded therein at least one of an abrasive and a soap additive.

8 Claims, 8 Drawing Figures

SCOURING AND CLEANING CLOTH

BACKGROUND

Figure 1:
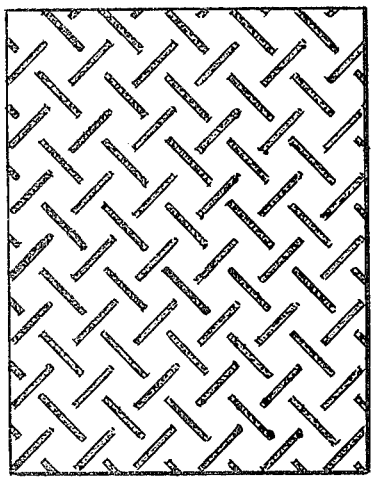

The invention concerns an absorbent textile fabric having a coating of a solidified binding agent which is applied wholly or partially to both surfaces in an open pattern.

Fabrics of this kind have been made and sold as wiping cloths and wash cloths, and they have been adapted by numerous special variations of their construction to different cleaning purposes. Recently, German Pat. No. 2,339,467 has disclosed a synthetic chamois cloth which is composed of a moisture-absorbing textile fabric which is provided with a continuous plastic coating treated to make it porous, for the achievement of a good attack upon the surface to be wiped. This has not been entirely satisfactory inasmuch as the porous surface, when used, for example, as a wiper for the removal of food scraps, has a tendency to become clogged, thereby losing much of its cleansing action. An additional difficulty can result from the fact that it is normally very difficult to remove entirely dirt residues which have become trapped in the support fabric, especially those having fatty components, because the relatively closed coating makes it difficult to wash them out. It is especially for this last reason that such chamois cloths have certain limitations as to their range of usefulness.

THE INVENTION

The invention is addressed to the task of developing a universally usable cleaning cloth similar to the above-described kind, which will be of improved effectiveness in wet cleaning, especially against smeary and hardened substances, and which, due to a special structuration and a special composition of its surface, will have a virtually constant effectiveness throughout its life.

This task is accomplished in accordance with the invention in that, on the surfaces of the cleaning cloth, a binding agent is printed in the form of superelevated bars offset from one another, in which, on at least one side of the cleaning cloth, there is embedded an abrasive and/or a soap additive treated, if desired, with aromatic substances.

It is desirable that the bars be associated with one another in a pattern, with the avoidance of straight passages through them, and some of the bars can, if desired, have an other than rectilinear shape, such as for example an angular shape or any other desirable shape. In one special embodiment, provision is made for the use of a consolidated nonwoven fabric of natural or synthetic fibers as the absorbent textile fabric, such fabric being so coordinated in its properties and thickness with the bar pattern on its surfaces that the pattern can be pressed down into the nonwoven fabric so as to produce an even surface, using a variable pressing force. An especially high utility is achieved generally when the sum of the individual areas covered by the bars amounts to from ten to fifty percent of the total area, preferably twenty to thirty percent. It is especially advantageous to use for the surface coating binding agent dispersions prepared from polymers of butadiene-acrylonitrile, butadiene-styrene-rubber latex, or polyacrylates. In one advantageous embodiment, the face side of the cleaning cloth of the invention is printed with a foamed binding agent dispersion, while the reverse side has an unfoamed pattern containing abrasive, the patterns being able to be distinguished from one another, if desired, by their color and/or structure.

For the preparation of the supporting textile fabric, it has proven to be advantageous to use absorbent fibers when the cloth is to be used as a wet cleaning or scouring cloth. With regard to the prevention of loading up with dirt, it is of especial importance that the pattern is applied so as to avoid straight passages or closed structures, and that it is superelevated in a relief-like manner above the textile surface of the cleaning cloth.

Figure 2:
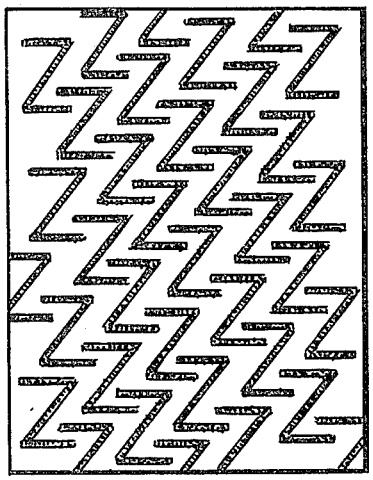
Figure 3:
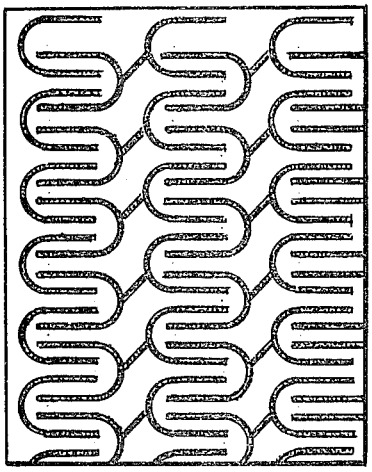
Figure 4:
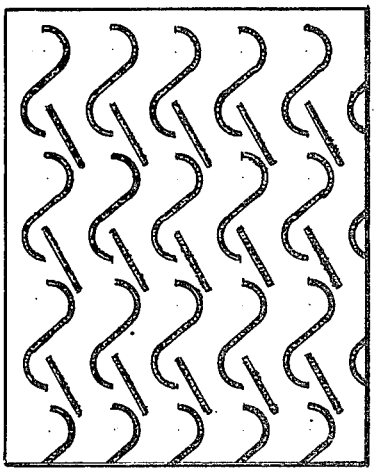
Figure 5:
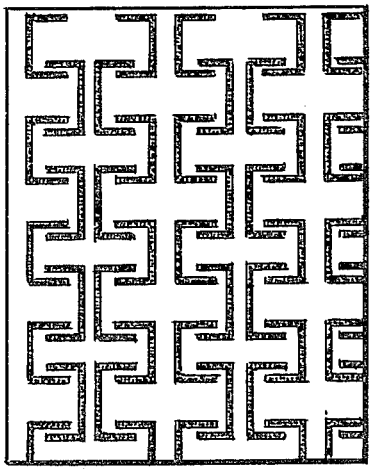
Figure 6:
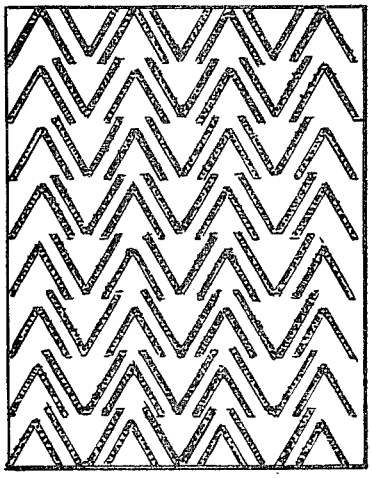
Figure 7:
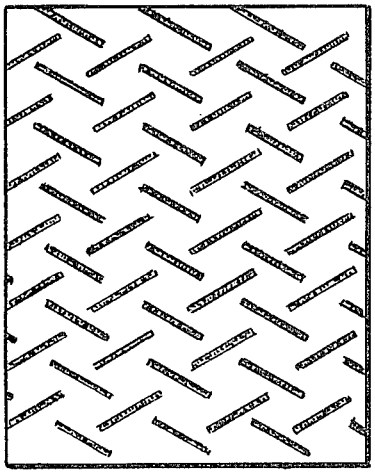
Figure 8:
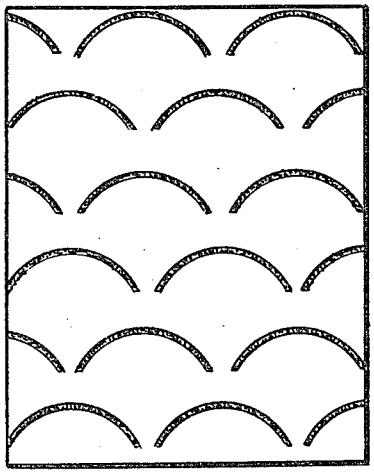

A number of exemplary forms of desirable patterns are represented in the appended FIGS. 1–8 which are plan views of scouring and cleaning cloths in accordance with the invention showing the printed superelevated bars. The subject matter of the invention is not, however, limited thereto, and instead, the "bars" can have other shapes under the limiting conditions set forth above.

When the force used in pressing the bars down is only slight, these bar-like structures can have a squeegee-like action, which is advantageous in that it largely prevents particularly the penetration of smeary substances into the finely porous surface of the textile support material. Of course, there is no way of keeping this surface entirely free of fouling; nevertheless, due to the open surface structure of the cleaning cloth of the invention, it has an extraordinarily great self-cleaning ability, i.e., the dirt that has penetrated can be removed without great difficulty later on in most cases by washing it out.

For adaptation to certain applications, it is desirable to use different grit sizes for the abrasives that are to be incorporated. Although scouring powders, such as quartz flour of a grit size between 400 to 600, are used in the household to prevent scratching, coarser grits are often better suited to other applications, such as corundum of a grit size between 180 and 400, for example. It has proven to be desirable in this regard to identify the coarseness of the incorporated abrasive by associating it with a certain color code. Also, the incorporation of wetting agents or soaps, which promote in a special manner self-cleaning ability, can be given consideration.

The principal field of the application of the cleaning cloth of the invention is probably in the household. However, the uncommon mechanical properties, especially of those cloths in whose bar pattern an abrasive is incorporated, make them applicable also in the industrial field, for example in the form of abrasive belts for galvanized pieces or as polishers.

It will be appreciated that the instant specification and claims are set forth by way of illustration and not limitation, and that various modifications and changes may be made without departing from the spirit and scope of the present invention.

What is claimed is:

1. A scouring and cleaning cloth comprising a consolidated non-woven fabric composed of one of natural or synthetic fibers and having a coating of a solidified binding agent on at least a portion of each surface in an open pattern applied by a printing process, said pattern comprising superelevated bars so disposed with respect to one another to avoid a straight passage therethrough, the bars in at least one of the surfaces having embedded therein at least one of an abrasive and a soap additive, the non-woven fabric having a thickness sufficient to permit the printed surface portions to be pressed into the cloth to conform to a planar surface.

2. A scouring and cleaning cloth of claim 1, wherein a part of the bars has a non-rectilinear shape.

3. A scouring and cleaning cloth according to claim 2, wherein the non-rectilinear shape comprises an angular form.

4. A scouring and cleaning cloth of claim 1, wherein the sum of the individual surfaces covered by the bars is 10 to 50% of the total surface.

5. A scouring and cleaning cloth of claim 4, wherein the surface covered is 20 to 30% of the total surface.

6. A scouring and cleaning cloth according to claim 1, wherein the superelevated bars contain abrasive, and the abrasive-containing superelevated bars are on one surface only.

7. A scouring and cleaning cloth having a coating of a solid binding agent on at least a portion of each surface in an open pattern applied by a printing process, said pattern comprising superelevated bars, the bars in at least one of the surfaces having embedded therein at least one of an abrasive and a soap additive, the binding agent for the surface coating being a heat-sensitive polymer, comprising one of butadiene-acrylonitrile, a butadiene-styrene-latex, or a polyacrylate.

8. A scouring and cleaning cloth having a coating of a solid binding agent on at least a portion of each surface in an open pattern applied by a printing process, said pattern comprising superelevated bars, one surface being printed with a foamed binding agent dispersion and the other side being printed with an unfoamed, abrasive-containing binding agent dispersion.

* * * * *